United States Patent [19]

Habegger

[11] Patent Number: 5,039,006

[45] Date of Patent: Aug. 13, 1991

[54] HOME HEATING SYSTEM DRAFT CONTROLLER

[76] Inventor: Millard A. Habegger, 5280 Sun Dial Pl., Boulder, Colo. 80301

[21] Appl. No.: 394,680

[22] Filed: Aug. 16, 1989

[51] Int. Cl.[5] ..... F23N 5/24

[52] U.S. Cl. ..... 236/11; 431/21; 431/22; 236/1 G

[58] Field of Search ..... 236/1 G, 10, 11, 49.1, 236/49.2, 49.3; 431/20, 22; 237/50, 53, 55; 126/116 A, 116 R

[56] References Cited

U.S. PATENT DOCUMENTS

| | | | |
|---|---|---|---|
| 2,184,983 | 10/1935 | Tornquist | 158/1 |
| 3,537,803 | 11/1970 | Ignazio | 431/22 |
| 4,079,727 | 3/1978 | Smith | 126/307 |
| 4,204,833 | 5/1980 | Kmetz et al. | 431/22 |
| 4,334,258 | 6/1982 | Seeman et al. | 431/22 X |
| 4,401,425 | 8/1983 | Gable et al. | 431/21 X |
| 4,406,396 | 9/1983 | Habegger | 236/1 |
| 4,571,912 | 6/1988 | Monette | 126/307 |

*Primary Examiner*—Henry A. Bennett

*Attorney, Agent, or Firm*—Dorr, Carson, Sloan & Peterson

[57] ABSTRACT

A forced air heating system having a dedicated supply duct for delivering heated air to the heated portions of the building and having an open air return system which uses the rooms, hallways, door openings, etc. of the building for returning air back to the furnace for reheating and recirculating. The elimination of a dedicated return air duct significantly improves the distribution airflow volume and thereby the efficiency and comfort of the central heating and air conditioning. The system includes a flue draft controller which monitors the flue draft at all heating applicances, such as furnaces, hot water heaters, etc., and servos a damper in a single main flue serving all appliances to optimize the flue draft for all appliances. If the flue draft becomes inadequate in any appliance, the controller shuts down heating appliances, as well as all heating system circulation fans, power fans and building exhaust fans which can affect the flue draft. The controller also enables building safety devices, such as smoke and combustible gas detectors to shut down heating appliances when a building safety problem is detected.

53 Claims, 6 Drawing Sheets

HOME HEATING SYSTEM DRAFT CONTROLLER

FIELD OF THE INVENTION

This invention relates to a forced air heating system having only a single supply duct for delivering heated air from a furnace to the heated areas of a building. The system does not have a dedicated return duct. Instead, the distributed air is returned through the open areas of the building, such as rooms, open doors, hallways, etc. back to the input of the furnace distribution fan for reheating and redistribution through the supply duct. The invention further comprises a flue draft controller which monitors the flue draft of all heating appliances, such as the furnace, hot water heaters, etc. and shuts down the entire system, as well as any exhaust fans in the event that an inadequate or dangerous flue draft is detected in any heating appliance.

BACKGROUND OF THE INVENTION

An air distribution system should efficiently redistribute weather related unbalanced heating or cooling or high humidity conditions throughout the building in which it is installed. The currently available systems do not perform this function efficiently because of the air flow restrictions imposed by the associated duct system. In many cases, this air flow is a factor of 10 or more below that which is necessary to give acceptable performance. As a result, it often takes a forced air heating or cooling system a long time to respond to a request for a change in temperature. An efficient system should respond very rapidly to a requested change in temperature.

The hotel-motel industry has recognized the problems with central air distribution systems and has switched almost totally to individual room heat pumps. The air conditioning industry sells a large number of window units because existing central air distribution systems are costly and inadequate. The deficiency in home air circulation, especially in the basement area, has led to health and safety problems with indoor pollutants such as radon gas. The primary industry response has been the provision of high efficiency furnaces or heat pumps. These units are not worth the added expense and cannot efficiently heat the average home because an associated streamlined duct system which can provide a high air flow volume is also needed to achieve improved performance. For instance, the quoted efficiency of nearly 100 percent for the newer furnaces is measured with the furnace operating on a test stand under the ideal conditions which includes the manufacturer recommended distribution air flow volume. When that unit gets installed in an actual home where the duct system is usually inadequate, the efficiency decreases and becomes meaningless. To achieve efficiency, heat must be removed from the furnace and delivered to where it is needed. If the heat is not removed from the furnace, it will go up the chimney or the furnace will cycle on and off with associated cycling losses to degrade the efficiency.

The typical home duct system has a low air flow as the result of numerous square corners and turns in the ducts. Duct systems should be designed to be streamlined so that the air flow encounters only rounded corners. This is usually not done because of the added expense involved in producing streamlined ducts. No high efficiency heating or cooling unit can produce efficient system performance when the duct air flow is low. The supply duct and the building code required enclosed return air duct system constitute a lot of duct work that competes for space in the vicinity of the furnace and creates difficult choices for proper streamlining. The net result of all this duct work is to severely throttle the duct air distribution fan and to degrade the system efficiency.

The duct air distribution fan can create air pressure differentials much larger than the feeble flue draft. Under certain conditions, the distribution fan can completely destroy flue draft and create dangerous conditions for life and property. Building codes that require a totally enclosed return air system are the only known means to protect the relatively feeble flue draft from the pressures generated by the duct distribution fan. These code requirements are subject to many interpretations and much confusion. This results in a tacit approval for throttling the distribution fan. The throttling of this fan guarantees it will not destroy the flue draft; but it also degrades the distribution airflow volume.

The only safety device that has had some use in the past is a spillage sensor for use with gas fired appliances. Such a sensor is a thermostat switch mounted in the relief opening of a draft hood. When the flue outlet of the draft hood becomes blocked, the hot flue gasses are forced out through the relief opening and the thermostat switch is heated to its activation point and opens control power circuit to the heating appliance. Such switches are bulky and are not sensitive and a lot of flue gasses can spill before the switch trips. Furthermore, there is a substantial problem of attaching and physically securing electrical wires in a hot environment such that they are not shorted out by other metal in the vicinity. For these reasons spillage sensors are rarely used.

A more modern method of measuring available flue draft is described in U.S. Pat. No. 4,406,396. The method of this patent consists of putting a first temperature sensor, T1, inside the relief opening above the bottom of the skirt of the draft hood and putting a second temperature sensor, T2, in the air outside of and surrounding the draft hood. The temperature differential between these two sensors is related to the available draft. The two sensors have an operational transition region where the temperature differential between the two sharply increases as the flue draft goes from excessive to inadequate at the incipience of spillage. The optimum flue draft situation exists when the inner sensor T1 is approximately 15 degrees Centigrade hotter than the outer reference sensor T2. Because of the sharp rise in temperature differential as the available flue draft is decreased, the exact temperature differential is not critical and could easily be 25 degrees with equally effective results. A temperature differential of approximately 50 degrees is indicative of the onset of spillage and the heating appliance must be shut down.

It can be seen that the forced air heating and cooling systems presently available are not efficient and are inadequate because of the poorly designed duct works and duct systems associated with such systems. Efficiency is further reduced by the requirement for a separate dedicated return duct system. Since the return duct system is usually of a non-streamlined design which includes sharp corners and the like, the efficiency of the entire system is degraded.

SUMMARY OF THE INVENTION

The present invention solves the above discussed problem and achieves an advance in the art by providing a forced air heating and cooling system that has a supply duct and that uses an open air return system comprising the rooms, halls, open doors, grills, etc. of the structure in which the system is located to return the distributed air back to the input of the furnace fan and heat exchanger for reheating and recirculation. The provided system includes a flue draft controller which performs a number of safety functions including the monitoring of the adequacy of the flue draft of each appliance and the shutting down of the furnace, fans, etc. when the flue draft on any heating appliance becomes inadequate.

The flues for each heating appliance are equipped with sensitive draft detectors and whenever the draft of any appliance turns from negative to positive, the furnace is shut down, all fans that can affect the flue draft are turned off, and an alarm is sounded. Home occupants can remedy the situation by opening a door to unblock the return air flow and reactivating the system. This improvement allows the sealed return air duct system of the prior art to be eliminated and building areas such as hallways and stairwells to be used for a low resistance air path back to the furnace distribution fan intake. Air gratings in doors and walls can also be provided for return air movement. System shut down can occur if the return air path is closed or blocked. The flue draft controller of the invention detects a problem with flue draft and maintains safety by shutting down the system.

The flue draft controller of the invention includes draft sensors at the draft hood of every heating appliance, circuitry which controls a relay coil controlled circuit breaker in the 24 volt AC input of the system, circuitry to control the position of a flue damper in a main flue whose function is to optimize the draft to all heating appliances, circuitry to shut off both, kitchen and attic fans, thermal fuses located in all heating appliance draft hoods, an alarm which alerts home occupants if a shut down has occurred, circuitry to control auxiliary fans used to remove additional heat from the furnace flue, and circuitry that enables smoke and combustible gas detectors to shut down the system if dangerous conditions are detected.

The novel elements of the system of the invention include a reliable draft sensor comprising a single tube structure having a pair of temperature measuring thermistors. One thermistor is inside the draft hood. The other thermistor is outside the draft hood. The thermistors have identical negative temperature versus resistance curves and are electrically in series. A signal representing the flue draft is applied to a conductor connected to the junction of the series connected thermistors. This signal is a function of the temperature difference between the two thermistors and is independent of common temperature shifts. An operational temperature difference between the two thermistors at the ends of the tube is maintained with a tube material which has a low thermal conductivity such as stainless steel.

Also novel is the mounting of a thermal fuse at the end of the sensor tube placed in the relief opening of the draft hood. This thermal fuse is a redundant safety system which shuts down the system, power fans and all heating appliances in case the flue draft controller electronics fail. The thermal fuse is about the size of an electrical fuse and consists of a low melting temperature alloy which conducts electrical power when it is intact. If the fuse temperature exceeds the trip temperature, the alloy melts and the electrical path is broken.

Optimization of the flue draft to all heating appliances is controlled by a damper servo which responds to the draft sensor of the appliance which indicates the highest demand for additional draft. Draft sensor inputs from all heating appliances are fed to a damper control circuit and the servo adjusts the damper position so that all operating appliances have an adequate amount of draft. Draft requirements vary substantially throughout the operating cycle from a cold flue at appliance turn on to a heated flue and appliance turn off. The servo continually tracks the draft requirements for one or more appliance operations. If the draft at any appliance ever goes from negative to positive, the control system shuts everything down.

On a conventional system it made no sense to install fans to remove additional heat from the furnace flue. Such heat would have been wasted through the relief opening of the draft hood. Furthermore, there is the problem that if one removes too much heat from the flue, the draft could be cut back severely to present danger to life and property. With the provision of the system of the invention, one can install flue fans or even an auxiliary heat exchanger because the heated air is pulled into an open distribution fan intake and is not wasted into the draft hood. The system of the invention monitors the available flue draft and shuts down the system if the available draft becomes insufficient. From a safety aspect, a single damper and a single flue is acceptable because the flue draft controller receives and integrates draft information from all appliances. If the electronics in the flue draft controller should fail, the thermal fuse will open and cause the damper to open. The controller circuitry incorporates features which trips the circuit breaker if any of the draft sensors should become unplugged, if any of the thermistors become shorted or open electrically or if the wrong end of the draft sensor tube were to be mounted in the relief opening of the draft hood.

If, under normal operation, a power distribution fan or exhaust fan destroys the available draft, the voltage between the thermistor pair on an operating appliance exceeds set limits and the circuit breaker in the 24 volt AC control circuit opens to shut down the system. This shut down rings an alarm to notify the home occupants of problems. The occupants can reopen the air path back to the distribution fan intake or open an outside door or window to provide an air inlet for the exhaust fan. The occupants restart the system by resetting the circuit breaker and if the problem has not been resolved, the system will shut down again. The important point is that the system of the invention keeps everything safe.

DESCRIPTION OF THE DRAWINGS

These and other objects and features and other advantages of the invention may be better understood by a reading of the following description thereof in which.

DETAILED DESCRIPTION

Figure 1:
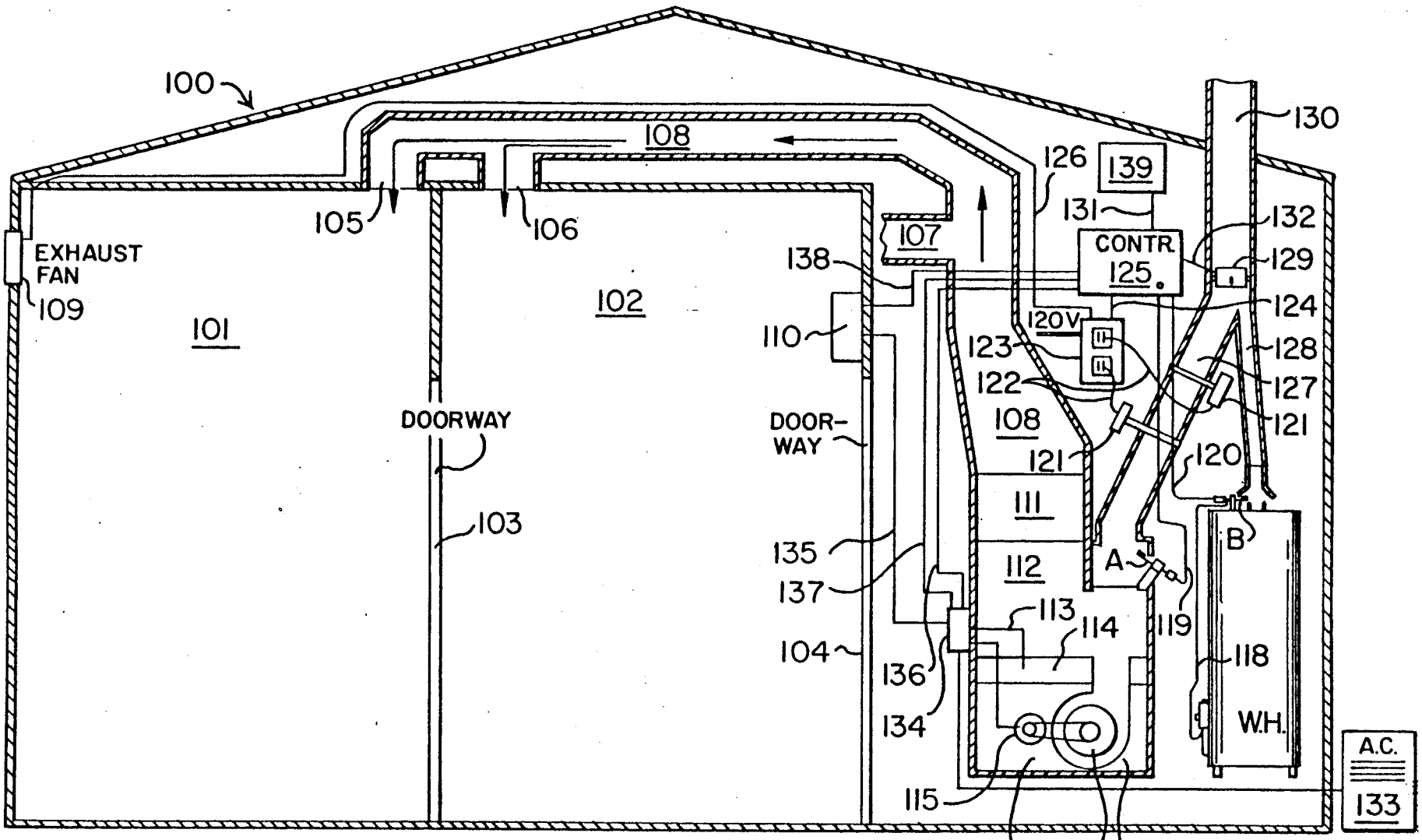
FIG. 1 discloses the mechanical system details of the invention.

FIG. 1 disclosed the mechanical details of a system embodying the invention. Shown on FIG. 1 is a building such as a house 100, having rooms 101 and 102 and heating and cooling equipment including a furnace F and a water heater WH shown to the right of room 102. Room 101 has an exhaust fan 109 and room 102 has a thermostat 110 for controlling the heating/cooling system. The furnace system F has an outlet duct 108 for supplying heated air to the rest of the structure. Duct 108 has a hot air outlet 105 serving room 101 as well as a hot air outlet 106 serving room 102. Duct 108 also has a hot air outlet 107 serving other rooms (not shown) of the structure 100. Hot air is delivered by the system of this invention from the furnace via supply duct 108 to rooms 101 and 102. After heating these rooms, the distributed air is returned to the furnace system via open doorway 103, and open doorway 104 back to the air input 116 of the duct distribution fan 117 having motor 115. Furnace F has a burner 114, a heat exchanger 112, a connected air conditioner coil 111, and supply duct 108 for receiving heated air from the furnace or cooled air from the air conditioner coil 111 and for supplying it to the various portions of the structure 100. The air conditioner coil 111 is connected by appropriate plumbing (not shown) to an air conditioning compressor AC. Also shown on FIG. 1 is water heater WH and exhaust fan 109, such as kitchen or attic exhaust fan and a plurality of flue attached fans 121 for removing heat from flue 127 connecting the furnace draft hood flue outlet with the main flue 130. A controllable damper 129 is positioned in main flue 130 for controlling the draft of both the furnace and the water heater. The room thermostat 110 can be switched to control the furnace in winter and the air conditioner in summer. The furnace is connected by means of a furnace draft hood and a furnace flue 127 to the main flue 130. The water heater is connected by its own individual draft hood and a flue pipe 128 to the main flue 130. The sensor A is positioned in the draft hood of the furnace and it monitors the draft in the furnace flue 127. The sensor B is positioned in the draft hood of the water heater and it monitors the draft of the water heater flue 128. Both sensors are connected to the flue draft controller 125 of the invention via wires 119 and 120 to supply the controller with signals indicating the adequacy of the draft in the furnace and the water heater flues 127 and 128. The controller 125, in turn, is connected to the thermostat 110 and to junction box 134 for controlling 24 volt AC power to the furnace burner and the air conditioner. As is subsequently described, controller 125 monitors, with the assistance of sensor probes A and B, the adequacy of the draft in both the water heater and furnace flues and shuts down the system if the draft should become inadequate in the flue of either appliance.

No return duct system is provided in the system of FIG. 1. The supply ducts 108 deliver air to various rooms. With a reasonably tight shelter, the absolute pressure in the rooms can actually be elevated above the outdoor barometric pressure and it is not difficult with large doors, hallways and stairwells to keep return air velocities very low and the pressure drop in the open return also very low. Hence, the air pressure in the vicinity of the heating appliance is always at or above the outdoor barometric pressure so there is little interference with flue draft. In well designed open return air systems, the problems of a duct distribution fan 117 interfering with the flue draft can be almost nonexistent. Closing of a door or the blocking of an air grating in the return path may cause a flue spillage problem when the distribution fan 117 pulls air out the flue. To make the open return air system safe, the controller 125 of the present invention is a necessity. The advantages in efficiencies, comfort and safety of an open return air system far outweigh the minor inconveniences of an occasional shutdown. The controller 125 is of lower cost than the return duct work that has been eliminated, heating and air conditioning is more efficient, unbalanced weather related heating and cooling can easily be redistributed, and dangerous indoor pollutants, radon gas and excess humidity can be redistributed for easier exit through shelter leakage.

The addition of the controller 125 of the invention to an existing system is easily done with relatively few changes. The return air duct is simply opened at the fan intake 116 and the remaining return duct work is left in place. Draft sensors, such as A and B, are installed in the draft hoods of all heating appliances. A relatively large two wire cable 118 connects the water heater sensor B to the water heater gas valve assembly where it is attached to a commercially available thermocouple line interceptor.

A servo controlled flue damper 129 is installed into the single main flue 130 which serves both the water heater flue 128 and the furnace flue 127. Damper 129 is attached by cable 132 to controller 125. Controller 125 is attached to a wall or suspended from the ceiling to minimize cable lengths. Wires 136 and 137 from junction box 134 carry the 24V AC control voltage to the controller 125. The controlled 24V AC of the present invention is on wire 138 attached to thermostat 110. Junction box 134 contains a 24 volt transformer and interconnections to thermostat 110, to a furnace fuel solenoid, and other elements as shown on FIG. 3.

A control cable 124 connects controller 125 to a power outlet box 123. Auxiliary fans 121 mounted on the furnace flue are electrically plugged into outlet box 123. The purpose of these inexpensive fans are to remove additional heat from the furnace flue. This removed heat enters the open distribution fan intake 116. This outlet box 123 houses relays driven by fan control 900 (FIG. 3) and the presence of 18 volts power. This latter relay controls exhaust fans 109 such as bathroom and kitchen plus attic exhaust as shown on FIG. 3. Cable 131 connects smoke and gas detectors 139 to controller 125. If a dangerous condition of smoke or combustible gas is sensed, the controller turns off heating systems and fans and opens damper 129.

The system of the invention requires no modifications to any existing equipment. Original equipment safety certification by approval agencies is unaffected. The furnace and water heater function identically as in the past. Either or both can fire simultaneously at any time.

Figure 2:
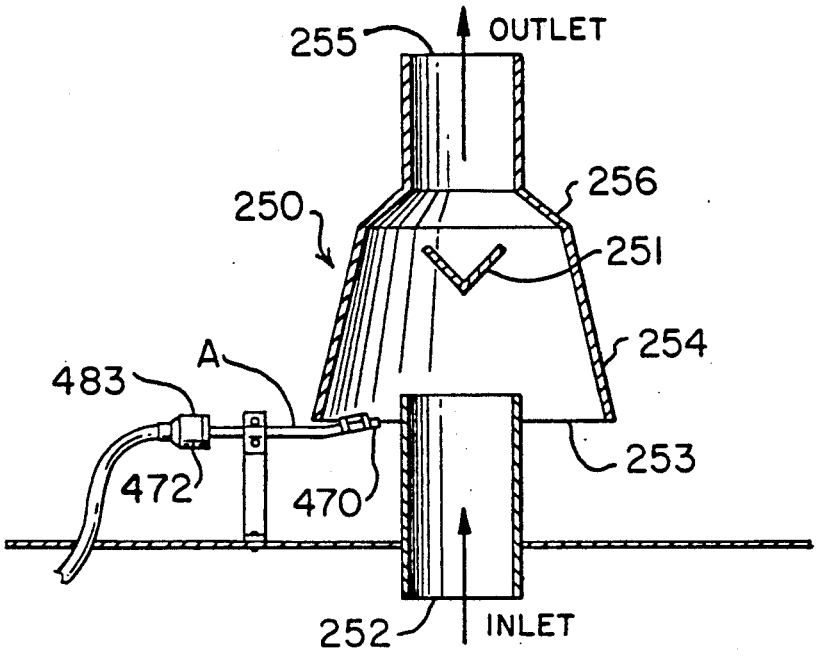
FIG. 2 discloses the details of a draft hood for a heating appliance.

The following describes and defines the draft hood terminology for the draft hood used in the system of the invention and shown in FIG. 2. A draft hood 250 is a fitting or device placed in, and made a part of the flue pipe from a heating appliance, or in the appliance itself, which is designed to: 1) Provide for the ready escape of the products of combustion in the event of no draft, back draft, or stoppage beyond the draft hood; 2) Prevent a back draft from entering the appliance; and 3) Neutralize the effect of stack action of the chimney flue upon the operation of the appliance. Baffle 251 is an object such as a plate or cone placed in the draft hood in such a position as to deflect the flow of the flue gasses, the flow of the air induced by the chimney flue, or both. Flue gasses are products of combustion plus excess air in appliance flues or heat exchangers (before the draft hood or draft regulator). Vent gasses are the products of combustion from fuel-gas burning appliances plus excess air, plus dilution air in the venting system above the draft hood or draft regulator. The general term for the passages through the draft hood 250 which conduct the flue gasses from the inlet pipe to the outlet is flueway. The inlet connection 252 is that portion of draft hood 250 which is attached to the flue outlet of the appliance and which conducts flue gasses into the draft hood 250. Relief opening 253 is provided in a draft hood 250 to permit the ready escape to the atmosphere of the flue gasses from the draft hood in the event of no draft, back draft, or stoppage beyond the draft hood, and to permit inspiration of air into the draft hood in the event of a strong chimney updraft. The portion of the draft hood 250 which serves partially or entirely as the outer wall of the flueway and which extends downward from the outer edge of the top or of the outlet connection is skirt 254. Flue gasses exiting through the relief opening of the draft hood due to lack of updraft or blockage of the draft hood exit is called spillage. Supports are the part or parts of a draft hood 250 which securely maintains the proper relative position of the skirt, top and outlet connection to the baffle, inlet connection, or both. The portion of the draft hood which connects the skirt to the outlet connection is the top, 256. Sensor A is shown on FIG. 2.

Figure 3:
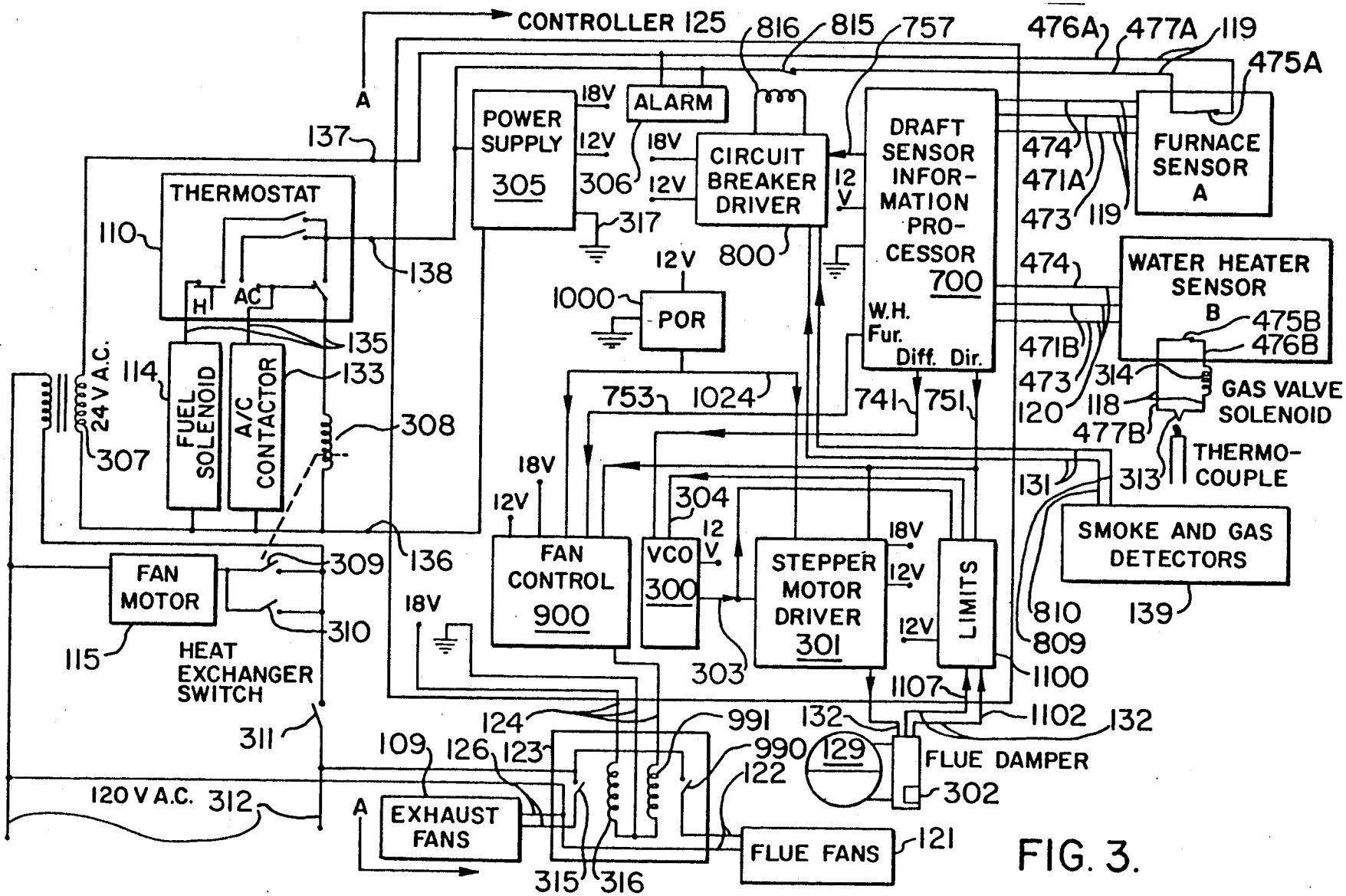
FIG. 3 discloses the system electrical details of the invention.

The system level circuit details of the present invention are shown on FIG. 3. Shown on FIG. 3 are various elements of a conventional heating/cooling system. These elements include a 120 volt AC supply 312, a 24 volt transformer 307 for powering the entire system, a furnace fuel solenoid 114, an air conditioner contactor 133, a distribution duct fan motor 115, a thermostat 110, as well as other various circuit elements whose function is subsequently described in detail. The flue draft controller 125 of the present invention is added to what may be termed "a conventional heating/cooling system." The flue draft controller 125 is shown to the right of the line A—A, while the elements of the conventional system are shown to the left of the line A—A. In a conventional system, without the flue draft controller 125 of the present invention, terminals 137 and 138 would be connected together so that thermostat 110 and fuel solenoid 114, air conditioner contactor 133 and the coil of relay 308 are all connectable across the 24 volt secondary of transformer 307. With the addition of the flue draft controller 125, terminals 137 and 138 are no longer directly connected and various circuit elements of the flue draft controller 125 are effectively connected in series between terminals 137 and 138 so as to supply terminal 138 with 24 volt power when the system is operating normally and to remove 24 volt power from terminal 138 upon the detection of any trouble condition, such as an inadequate flue draft or any other system abnormality.

Flue draft controller 125 includes a draft sensor information processor 700 which receives signals from sensors A and B indicating the adequacy of the flue draft in the hoods for the furnace and the water heater. Processor 700 responds to these signals and controls flue damper 129 by a VCO (voltage controlled oscillator) 300, a stepper motor driver circuit 301 and a limit circuit 1100. Processor 700 also controls the operation of flue fans 121 by means of fan control 900 so as to preclude the operation of the flue fans in the event of an inadequate draft. Processor 700 also controls a circuit breaker 815 via a circuit breaker driver 800. Upon the detection of an inadequate draft, processor 700 sends a signal over path 757 to circuit breaker driver 800 to open contacts 815 of circuit breaker to open the series connection between paths 137 and 138 to remove 24 volt power from the elements of the furnace and air conditioner shown to the left of line A—A on FIG. 3. Sensor A includes a thermal fuse 475A which melts when the temperature inside the furnace draft hood becomes excessive. The opening of this fuse also removes 24 volt power from path terminal 138 to disable the entire system. Sensor B on the water heater is generally similar to sensor A and contains thermal fuse 475B which melts in the event the temperature inside the hot water draft hood becomes excessive. The opening of this fuse disconnects the output of the gas hot water heater thermocouple with the gas valve solenoid to shut off the water heater.

The supply duct distribution fan motor 115 is controlled through contacts 309 and 310. Contacts 309 are controlled by relay coil 308. Contacts 310 are the typical heat activated contacts on the furnace heat exchanger. They are activated to close when the temperature of the furnace heat exchanger 112 exceeds a predetermined minimum value. The heat exchanger contacts 310 open when the heat exchanger temperature falls below this predetermined minimum value. Relay coil 308 is manually activated at room thermostat 110 or by thermostat 110 when the air conditioning contactor 133 is activated.

Any time duct distribution fan 115 operates, it can potentially interfere with the flue draft requirements for the operating furnace or water heater by reducing the absolute pressure below the ambient barometric pressure outdoors in the vicinity of the operating heating appliance. Also, an operating exhaust fan in the kitchen, bathroom or the attic, such as fan 109, needs a source of input air. In the case of a small exhaust fan, the house leakage is that source of air. As home construction moves in the direction of reduced air infiltration, house leakage at some point may no longer be adequate. When that happens, the effect of such fans will be the same as that for a large attic fan where house leakage is not adequate and if windows or doors are not opened, the air pressure inside the house in the vicinity of heating appliances is lowered below the air pressure outdoors. At such times, the air pressure at the heating appliance input is lower than the pressure at the outdoor exit of the flue. The flue draft is then positive rather than the desired negative value. With a conventional system, the heating appliance could operate and flue gasses would spill from the draft hood to create a danger to life and property. The controller of the present invention provides a safe shut down of the system with warning if the draft becomes inadequate.

Alarm 306 is connected across the series connected circuit breaker contacts 815 and thermal fuse 475A and since both are normally closed, there is normally insufficient voltage across alarm 306 for it to sound. If either circuit breaker contacts 815 or the thermal fuse 475A opens, there is essentially 24 volts AC across alarm 306 and it will sound. Alarm 306 can be a small piezoelectric device that can be driven by a wide range of low voltages or it could also be a mechanical device such as bell or buzzer.

The controller 125 power supply 305 is powered with 24 volts AC between paths 136 and 138 when circuit breaker contacts 815 and thermal fuse 475A are both closed. Power supply 305 comprises a full wave rectifier and a switching regulator which regulates its 18 volt output for a wide range of input voltages. The regulated 18 volts is used on the stepper motor driven damper and relays. The 12 volt output of supply 305 is obtained through a 12 volt linear regulator off of the 18 volts. This 12 volt supply is used to power all logic, to provide a current through the sensor assembly thermistors, and to power all operational amplifiers.

Relay coil 316 is connected to the 18 volt power source. Coil 316 is powered whenever circuit breaker contacts 815 and thermal fuse 475A are both closed. The purpose of relay coil 316 is to close contacts 315 to extend power to the exhaust fans 109. This allows exhaust fan 109 to operate as long as controller 125 has not opened circuit breaker contacts 815 or the thermal fuse 475A has not blown. The exhaust fan 109 on FIG. 1 symbolically represents all exhaust fans in the building served by the system of the invention. Such fans can include attic fans, kitchen fans, bathroom fans, as well as any other fans whose volume of air is sufficient to adversely affect the flue draft in the various heating appliances of FIG. 1. On FIG. 3, draft sensor information processor 700 acts on the draft information signals received from draft sensors A and B. This processor uses the information from the sensors to control the flue damper 129. It also controls circuit breaker 815 through coil 816 and flue fans 121. The difference output 741 of processor 700 is an analog voltage which ranges from 0 to 11 volts and which is a function of the maximum temperature difference T1–T2 of a pair of thermistors in either draft sensors A or B. The size of the difference signal 741 is indicative of the poorest draft at any of the heating appliances vented into the common flue 130 (FIG. 1). Built into processor 700 is a reference voltage such that if the maximum temperature difference signal T1–T2 is equal to this reference voltage, the difference output is zero. This reference voltage is the equivalent of the requirement that T1–T2 equal 15 degree Centigrade. When the maximum T1–T2 signal is above the reference voltage, the direction signal 751 of processor 700 is low to tell the damper motor 302 to turn in the direction of opening damper 129. When the maximum T1–T2 signal is below the reference voltage, the direction signal 751 is high to cause the damper motor 302 to turn in the direction of closing the damper. When the furnace draft sensor A is determining the difference output signal 741, the furnace/water heater output 753 has a logic low signal. This, in combination with a direction signal 751 output that opens the damper 129 tells the fan control 900 to start flue fans 121.

The information processor 700 also keeps circuit breaker contacts 815 closed as long as the T1–T2 signal from all sensors is between an established maximum and established minimum value. If a maximum temperature difference is exceeded due to spillage at any of the draft hoods, circuit breaker contacts 815 are opened to stop combustion in the furnace and to shut off distribution fan 115 and exhaust fans 109 and flue fans 121. The minimum level can be exceeded if the wrong end of the sensor tube is installed inside a draft hood relief opening. The maximum or minimum limits are exceeded if any of the sensor assemblies are unplugged from the information processor or any of the sensor leads are shorted or broken. This is a safety measure to shut down furnace combustion and stop distribution and exhaust fans when any of the draft sensors are defective.

A high signal on path 757 from information processor 700 is sent to the circuit breaker driver 800 to open the circuit breaker contacts 815. This high signal on line 757 starts a timer 812 (FIG. 8) in circuit breaker driver 800 which must time out before the relay coil 816 of the circuit breaker is activated to open contacts 815. The purpose of this time delay is to avoid tripping the circuit breaker due to a short time spillage when a heating appliance starts up. The delay time can be varied from 4.25 to 68 seconds. Many heating appliances will spill from the relief opening of the draft hood at start up for less than 30 seconds. If spillage ceases before the time out of the timer, the signal on line 757 goes low and the timer is reset so that the circuit breaker contacts 815 are not opened.

On FIGS. 1 and 3, the purpose of the single flue damper 129 is to optimize the available draft in flue 130. The flue damper motor 302 is servo driven based on the difference signal 741 produced by the information processor 700. The damper 129 opening is controlled by the maximum need for draft. Motor 302 response speed is controlled by the magnitude of the difference signal 741 which controls the clock rate output of voltage controlled oscillator 300. This oscillator is the commercially available CMOS chip CD4046BC. When the difference voltage 741 goes to zero, the VCO 300 stops oscillating and the stepper motor 302 stops. The clock output signal of element 300 is applied via line 303 to the stepper motor driver 301 which may be Sprague element UCN 5871B/EB. A stepper motor is used for element 302 because the desired motor speed can be obtained by the appropriate clock rate of VCO 300 rather than an expensive gear train with a lot of drag. The damper is spring loaded to the open position and the drag in a high ratio gear train can prevent the damper from reliably going to the open position when the power is removed.

Thermistors in each of sensors A and B in the relief opening of the draft hoods have a rather slow temperature response of approximately 10 seconds. This means that if the air temperature around a thermistor suddenly experiences a step function of delta degrees, the thermistor temperature will reach 0.63 delta temperature change in 10 seconds. With this slow thermistor response, the servo system is very sloppy with possible damper motor overshooting and hunting. To avoid these problems, a derivative input of the T1–T2 signals has been found to work very successfully. This derivative input is generated in the information processor 700 and is added to the difference signal 741. With this derivative input, the difference signal always anticipates what is happening to the thermistors.

The function of the limit circuit 1100 on FIG. 3 is to stop stepper motor 302 operation when the damper is either fully open or fully closed. Motor 302 stoppage occurs only if motor operation beyond fully open or beyond fully closed is attempted. Logic in limit circuit 1100 allows the motor to open the damper from a fully closed position. In a standby situation, the temperature difference T1–T2 signal can be substantially below the reference temperature and the difference signal is continually available to close the damper and hence something must limit motor operation. Likewise the situation can exist where all the available draft is needed and the damper is in the fully open position. The T1–T2 signal in this case is higher than the reference temperature to keep driving the damper 302 motor open. But there is no point in having the motor struggle against a stop.

The system function of relay coil 316 and switch 315 is to turn off all operating kitchen, bath or attic fans when spillage from draft hoods is detected by processor 700. The exhaust fan is seeking a source of air and if a window or door has not been opened to supply the exhaust fan, the fan may draw the air from an open flue and thus destroy the negative draft for an operating appliance. This destruction of the draft for an operating appliance is dangerous and the controller prevents this from happening.

Flue fans 121 are mounted on the furnace flue to remove additional heat from the flue for higher heating efficiency. With a conventional system having a closed return duct and a totally open flue, it did not make sense to remove this extra heat from a flue. This heat could not conveniently be introduced into the circulation system and most of it would be wasted into the open relief opening of the draft hood. In the system of the invention it is highly advantageous to remove as much heat from the flue as possible. Information generated by processor 700 and utilized by fan control 900 turns on and off flue fans 121 when the appropriate appliance is operating.

The function of the power on reset (POR) circuit, 1000, is to produce a single logic pulse when the 12 volt power of supply 305 first goes high. This logic pulse is used to set latches and stepper motor driver logic in a known initial state.

The operational description of heating, cooling, water heating and the air distribution is now given. With the furnace and water heater pilot lights operational in standby, the flues are heated and damper 129 is slightly ajar due to heat generated by the pilots and the hot water in the tank of the water heater. Most of this heat is not wasted but is kept in the home by the almost closed damper 129. Suppose thermostat 110 calls for heat. The fuel solenoid 114 of the furnace is electrically operated and the burner ignites. Within seconds, the thermistor in the furnace draft hood senses the high temperature of the furnace flue gasses. Flue draft sensor A now has the highest temperature differential T1–T2 signal and it controls the damper 129 to position the damper so that the temperature differential of T1–T2 goes no higher than approximately 15 degrees Centigrade. During the first 15 seconds of furnace operation it is very likely that the damper will go to the fully open position because the flue has not been heated to establish a draft. However, a good draft is soon established and the T1 thermistor of draft sensor A starts cooling down because excess air is entering the relief opening of the furnace draft hood. Damper 129 will close down again until the 15 degrees temperature differential is established. Initially there are large swings in the damper position. But after a good draft has been established, the damper moves slowly and with only small swings to a position of a partially closed flue. The degree of closure depends on how cold it is outside, blowing winds and the degree of over sizing in the flue.

Figure 5:
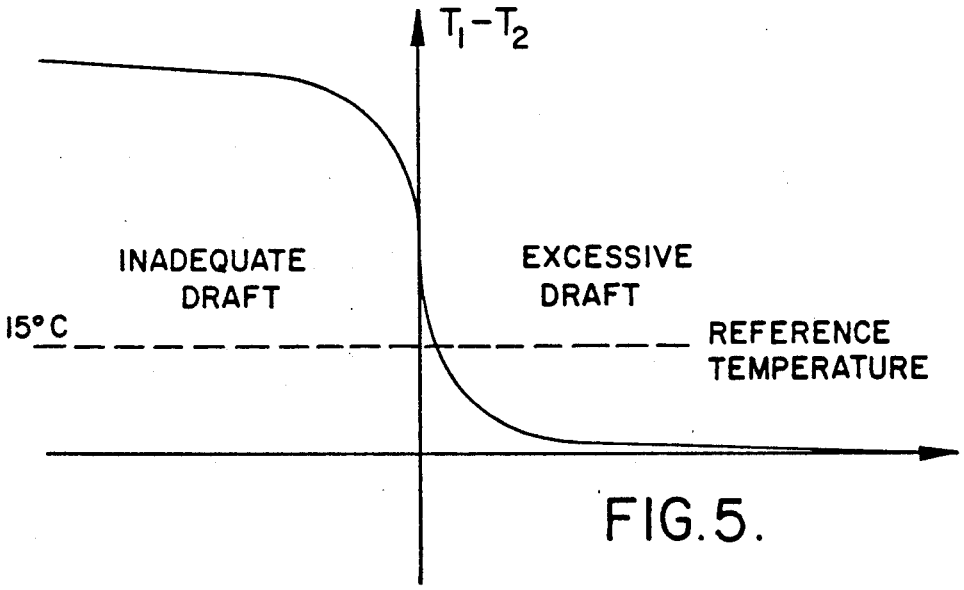
FIG. 5 discloses the sensed available draft signal of a sensor of FIG. 4 with respect to different temperature differentials.
Figure 4:
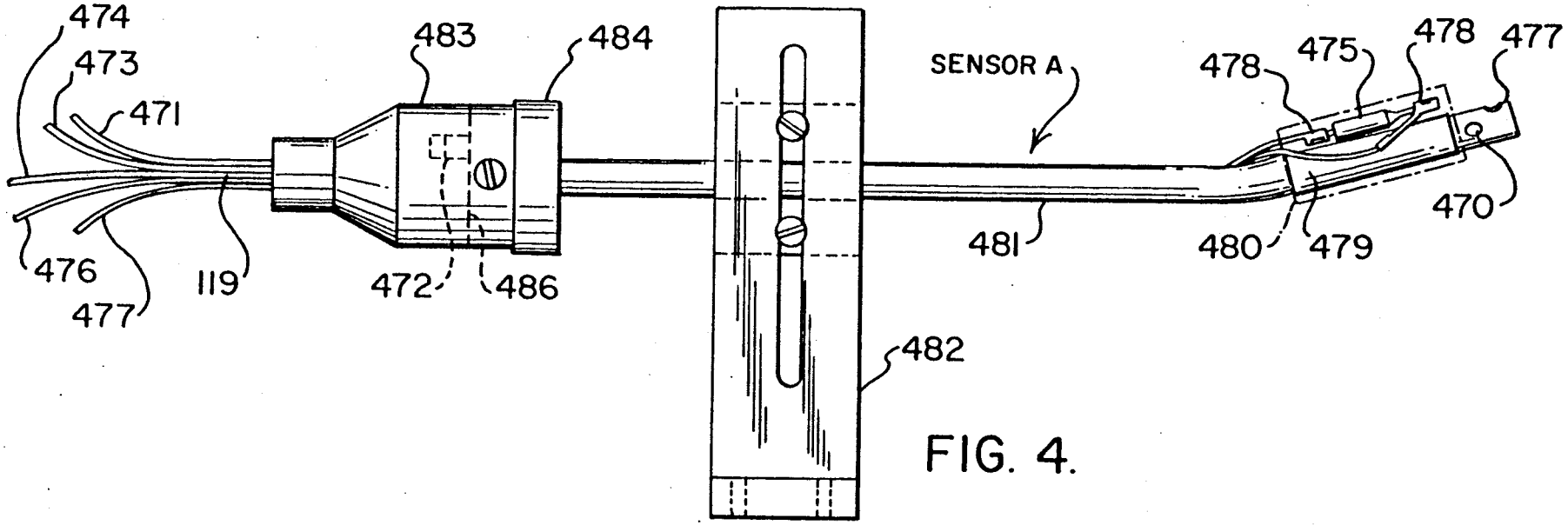
FIG. 4 discloses the details of a draft hood sensor.

The details of draft sensors are shown on FIG. 4 as comprising a mounting tube 481 having a first temperature sensing thermistor 470 in its front end. A second thermistor 472 is mounted in the bell housing 483 at the left end of sensor tube 481. The mounting of tube 481 relative to the components of a typical draft hood is shown in FIG. 2. Thermistor 470 senses the temperature inside the skirt of the draft hood 250. Thermistor 472 senses the temperature of the ambient air surrounding the draft hood. With excess draft, ambient air flows into the relief opening 253 (FIG. 2) of the draft hood 250 and the temperature of thermistor 470 will differ little from the temperature of thermistor 472 (see right hand side of FIG. 5). If the flue is partially blocked, there is less ambient air entering relief opening 253 and temperature of thermistor 470 rises. At some point the flue gasses may actually flow out relief opening 253 (spillage) and the temperature of thermistor 470 will be much higher than that of thermistor 472. The behavior of the available draft in the flue as a function of the temperature difference between T1 and T2 is shown in FIG. 5.

The temperature of a thermistor is converted to an electrical signal by passing an electrical current through it and measuring the voltage across the thermistor. The thermistors employed have a negative temperature coefficient which means that the electrical resistance sharply decreases in a nonlinear fashion when their temperature is increased. For sensing the flue draft, the factor of interest is in the temperature differential between thermistors 470 and 472 and not the absolute temperature of either. The present design provides a simple means of obtaining a voltage which is only a function of the temperature differential and has little dependence on the absolute temperature. As shown on FIG. 6, the circuit uses two thermistors 470 and 472 with identical negative temperature coefficients are connected electrically in series across conductors 473 and 474. The voltage across conductors 473 and 474 is maintained at 9 volts by processor 700. The voltage on conductor 471 relative to conductor 473 is a function of the relative resistances of the two thermistors at a given temperature (resistance difference is only due to the geometries of the two thermistors). This junction voltage is a strong function of the temperature differential of thermistors 470 and 472 and is almost completely independent of the absolute temperature. This configuration works so well that precision thermistors are unnecessary and thermistor resistance tolerances of $\pm 5$ percent are perfectly acceptable. The optimum draft is with a temperature differential of T1–T2 of approximately 15 degrees Centigrade. The differential is built into the information processor 700 on FIG. 3 as a reference voltage. The desired temperature differential of 15 degrees Centigrade is shown in FIG. 5 as the horizontal dashed line labeled "reference temperature".

Also shown in FIG. 4 is a thermal fuse 475 mounted near the right end of sensor tube 481. Fuse 475 fits inside the relief opening of the draft hood of FIG. 2. Thermal fuse 475 is a back up safety device that melts when a temperature of 87 degrees Centigrade is exceeded. The main 24 volt system control power passes through the fuse and when this power is interrupted, the furnace, duct distribution fan 115, exhaust fans 109 and flue fans 121 become inoperative. Also, the thermal fuse mounted in the water heater draft hood sensor B passes the thermocouple 313 generated voltage powered by the water heater pilot light. When this fuse opens, the gas valve solenoid 314 (FIG. 3) in the water heater opens and makes the water heater inoperative. These thermal fuses should open only infrequently since the information processor 700 senses the rising temperature and trips the circuit breaker 815. These fuses are somewhat difficult to replace and should only need replacement in case of an electronics failure in the controller. The fuses are held in place and protected electrically by silicone tape 480 wrapped around fuse 475 and tube 481. Fuse 475 is electrically isolated from tube 481 by a piece of shrink tubing 479 shrunk onto tube 481 below the thermal fuse. Good electrical connection to the ends of the fuse are made with commercially available gold plated small connectors 478. In replacing the fuse, these connectors are simply slipped off of the old fuse and slipped onto the new one.

Figure 6:
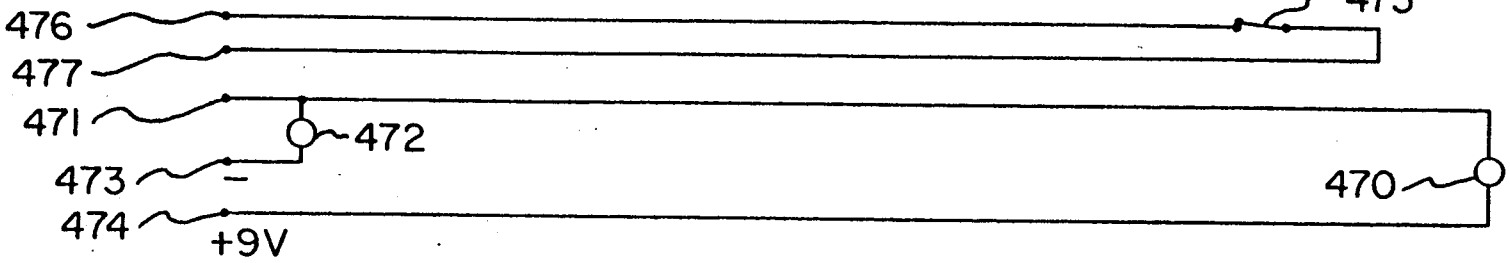
FIG. 6 discloses the circuit details of the sensor of FIG. 4.
Figure 7:
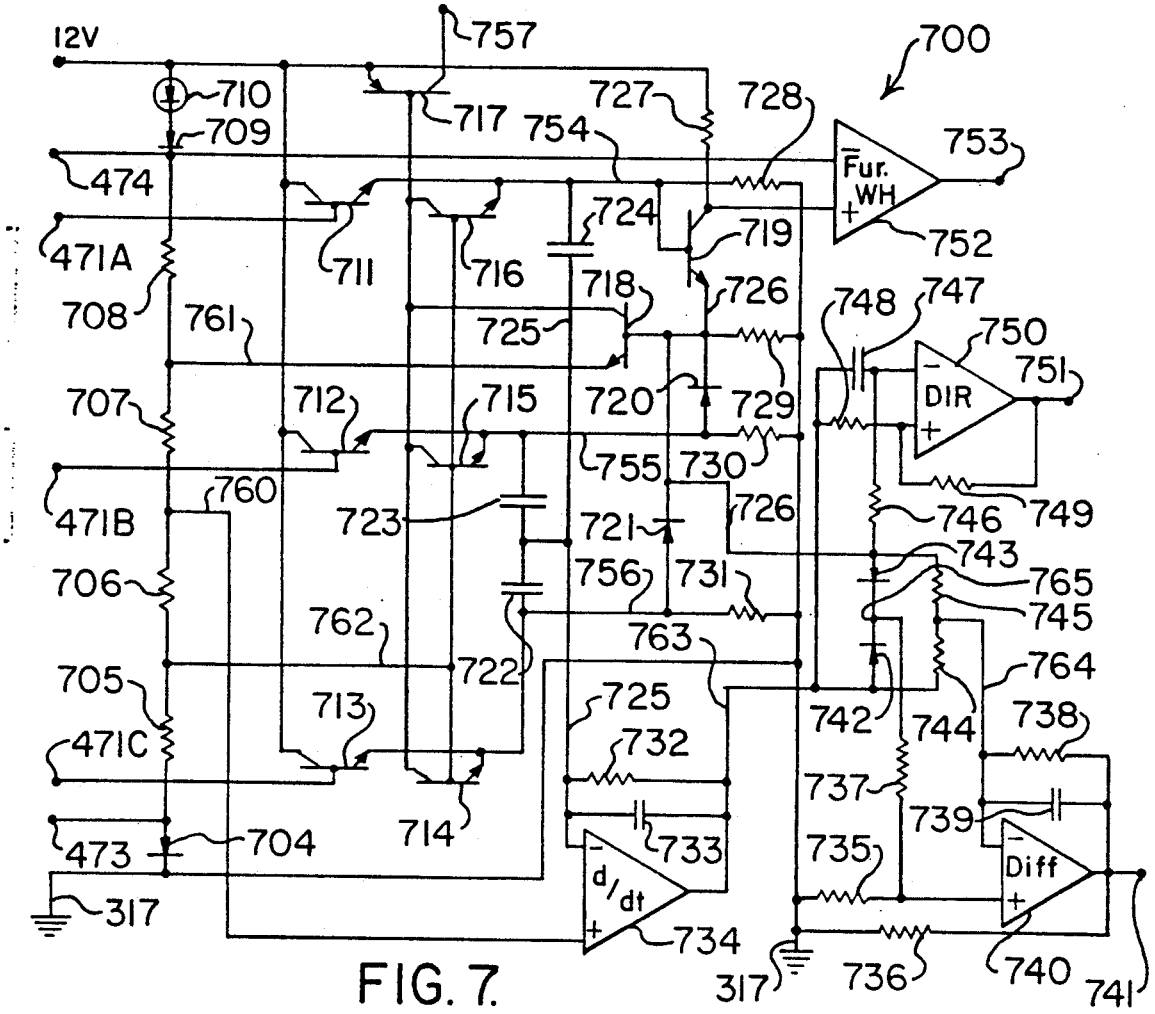
FIG. 7 discloses the circuit details of the information processor 700 of FIG. 3.

On the electrical circuit of FIGS. 3, 6 and 7, the thermistors 470 and 472 of a sensor are connected in series across a voltage of 9 volts between lines 473 and 474. As seen in FIG. 7, which shows the details of processor 700, the 9 volts is obtained from the regulated 12 volts by voltage drops through LED 710 and diodes 709 and 704. Thermistor 470 has a resistance of 10K ohms and thermistor 472 has a resistance of 5.0k ohms at 25 degrees Centigrade. Both are made from the same negative temperature vs. resistance material. With both thermistors at the same temperature, the voltage on line 471 is fixed, regardless of the absolute temperature, because this voltage is the result of a resistance ratio. This makes the draft sensor operation independent of the common environmental temperature. The voltage on a line 471, such as line 471A, relative to line 473 is a function of the temperature of thermistor 470 relative to the temperature of thermistor 472. The temperature of thermistor 470, which is positioned in the draft hood relief opening, rises as the flue of an operating heating appliance is partially blocked. Because of the negative temperature coefficient, the voltage on a line 471 rises and vice versa if the temperature of thermistor 470 drops relative to 472 the voltage on line 471 falls.

A function of information processor 700 is to take the maximum voltage on lines 471A, 471B and 471C of all sensors and compare this maximum with a reference voltage on line 760 (FIG. 7) to produce an output signal representing the difference on output line 741 which drives the servo controlled damper 129. Line 471C is a third sensor assembly mounted in the draft hood of another appliance and is an example of how the concept of information processor 700 can be extended to more than two heating appliances. This maximum voltage on lines 471A, 471B and 471C is also compared with the reference voltage on line 761 of FIG. 7 to determine if the circuit breaker 815 should remain in the normal closed position or should be opened due to a problem of spillage. If the maximum of lines 471A, 471B and 471C is higher than the reference voltage on line 760, then direction output signal 751 is low indicating that the servo damper 129 should be driven open. If the maximum of the lines 471A, 471B and 471C is below the reference voltage on line 760, then the direction output signal 751 is a logic high indicating that the servo damper 129 should be driven closed to limit the excess draft.

Another function of the information processor 700 is to determine the minimum value of the voltage on lines 471A, 471B and 471C and compare this minimum value with another reference voltage on line 762 of FIG. 7 to again determine if circuit breaker 815 should be left in its normally closed position or whether it should be opened because one of the sensor systems has malfunctioned. Sensor A is mounted in the draft hood of a furnace and on the flue of this furnace fans 121 are mounted to remove additional heat from the flue. Still another function of the information processor 700 is to determine when sensor A is in command status. This means that line 471A of FIG. 7 has a larger voltage than either line 471B or 471C. The fact that line 471A is in command status places output signal 753 at a low logic level. When line 471A is not in a command status, output 753 is at a high logic level. A low on output 753 is used by the auxiliary fan control 900 to turn on flue fans 121.

The criteria for installing the sensor assemblies in the draft hoods are few and simple but for safety reasons these criteria must be rigidly followed. Open sensor end 477 (FIG. 4) of sensor assembly tube 481 plus thermal fuse 475 must be located inside and above bottom of draft hood skirt 254 (FIG. 2). It is essential to place the sensor tube in a streamlined direct flow of the potential spillage. The large housing end 483 of sensor tube 481 must be outside and below bottom of draft hood skirt 254. Sensor tube 481 must not touch or be attached to the skirt 254 of draft hood 250 or any other potentially hot sheet metal. The sensor tube assemblies must be securely and rigidly mounted so it is not easily mispositioned.

Reference voltages 760, 761 and 762 on FIG. 7 are obtained by a series of resistors 705, 706, 707 and 708 connected across 9 volts. A well known technique in electronics to obtain the maximum positive value of several independent signals is to connect each signal through a diode to a common summing point with all diode cathodes connected to the summing point. The signal at the highest positive level will pass through the diode, but all other diodes will be back biased. Likewise to obtain the minimum signal from a number of independent signals, every signal is connected into a common summing point through a diode with all the anodes tied together at the summing point. These are the techniques employed in the information processor 700 to obtain the maximum and minimum levels of input signals on lines 471A, 471B, and 471C. However, rather than use diodes, it is more practical to use the base to emitter junction diode of a transistor. Lines 471A, 471B, and 471C are fed to the bases of transistors 711, 712, and 713 which, with resistors 728, 730 and 731, are in an emitter follower configuration. The purpose of these transistor amplifier stages is to reproduce signal levels 471A, 471B, and 471C at a lower impedance level so that the signals have more strength. The higher strength signals are on lines 754, 755, and 756.

The maximum summing point for signals 471A, 471B, and 471C is 726 through diodes 720 and 721 and the base to emitter diode of transistor 719. For these same signals, the minimum summing function is done through the base to emitter diodes of transistors 716, 715, and 714. The common summing point are the collectors of these same transistors which are all tied together. Also tied into this same summing point is the collector of transistor 718 which compares the value on line 726 to the reference voltage on line 761. If any of the 4 transistors 714, 715, 716, or 718 are turned on, the base of PNP transistor 717 is pulled low to turn on this transistor which, in turn, raises the voltage on lead 757 and trips the circuit breaker to open contacts 815. This would occur if any of the signals 471A, 471B or 471C exceeded either the maximum or minimum levels established by reference 761 and 762.

The lower input, as well as the output, of operational amplifier 734 is normally at the reference level 760. The circuit consisting of diodes 742, 743, resistors 744 and 745 is a full wave rectifier whose output across wires 764 and 765 is the absolute value of the difference voltage between conductor 726 on the anode of diode 743 and the output of operational amplifier 734 on the anode of diode 742. The absolute value of the difference voltage is amplified by operational amplifier 740 whose output is line 741 which is the difference analog signal to the flue damper 129. Operational amplifier 750 acts as a comparator with built in hysterises which compares the voltage at point 726 with the output of amplifier 734. With point 726 at a higher voltage than amplifier output 734, output 751 of amplifier 750 is a low logic level. When line 726 is below the output of amplifier 734, output 751 is high. A high or a low output 751 determines the direction of the damper servo 129.

When input line 471A from the furnace is in command status, transistor 719 is turned on by transistor 711 and its collector will be at a low level. Operational amplifier 752 compares the low voltage level on the collector of transistor 719 with the +9 volts on line 474. With transistor 719 turned on, output 753 of amplifier is at a low logic level indicating that sensor A of the furnace is in command status. When transistor 719 is turned off, line 471A is not in a command status and output 753 of amplifier is at a high logic level indicating that furnace sensor A is not in command status. Output 753 is one of the inputs to the auxiliary fan control 900.

As indicated previously, the output of amplifier 734 is at the reference level of line 760 in the steady state condition. Coupled into amplifier 734 is the time derivative of signals 471A, 471B, and 471C through transistors 711, 712 and 713, and capacitors 724, 723, and 722. If the voltage on line 471A from the furnace suddenly rises, the output of amplifier 734 is lowered, the difference amplifier 740 output 741 is raised and the direction output signal 751 of amplifier 750 is low. This would occur if sensor A were mounted in the furnace draft hood and the furnace were turned on. With the flue damper shut, flue gasses would reach thermistor 470 to rapidly start heating it. The voltage on line 471A would gradually rise but due to the derivative input to amplifier 734, the damper quickly moves towards open. As the damper blade opens, air starts to enter the draft hood relief opening which reduces the heating effect on thermistor 470. With too large a damper opening, thermistor 470 starts to cool and the voltage on line 471A starts dropping. The time derivative input signal to amplifier 734 has the opposite polarity and the output of amplifier 734 is raised. This momentarily stops the damper blade motion. This derivative input to amplifier 734 has been found to produce a substantial stabilizing effect on the damper servo loop.

Capacitors 733, 739 and 747 are utilized to lower the high frequency amplification of amplifiers 734, 740 and 750. Amplifier 734 needs to be a high impedance input amplifier in order to keep the derivative capacitors at a reasonable size.

Figure 8:
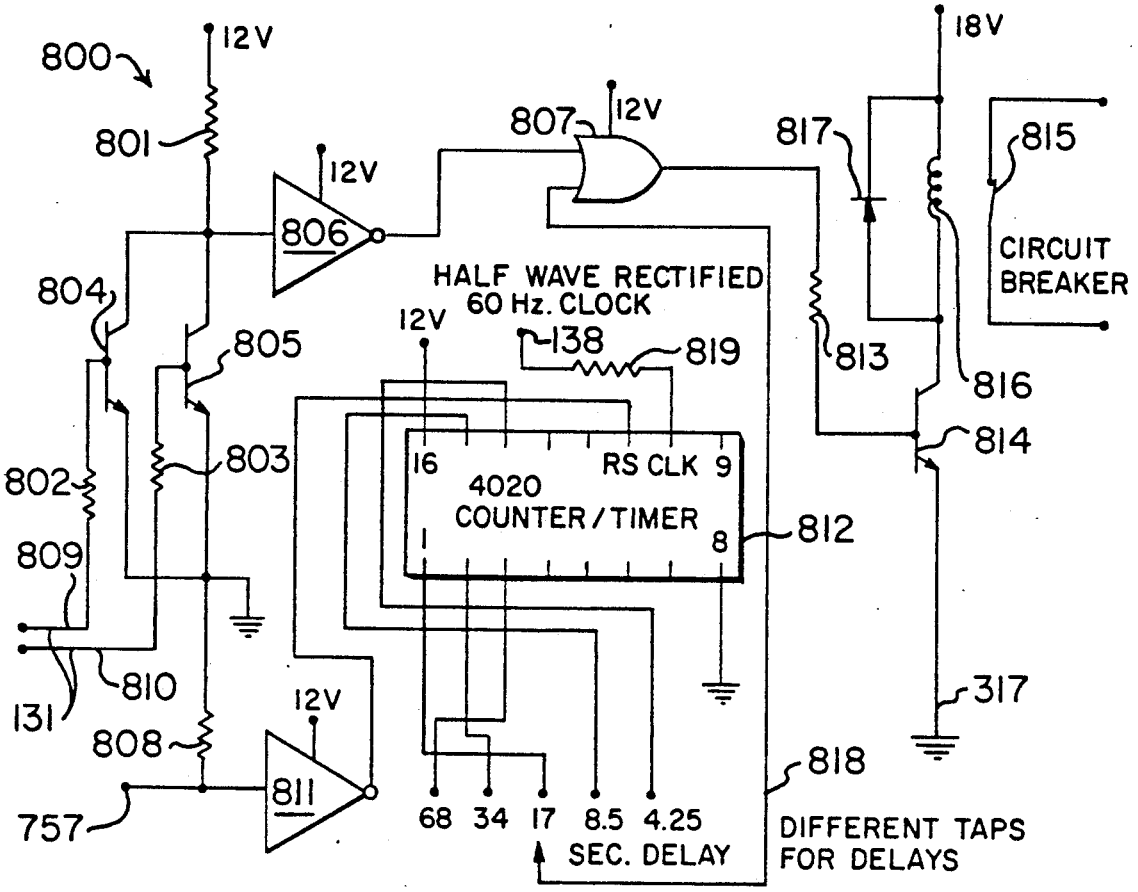
FIG. 8 discloses the circuit details of the circuit breaker driver 800 of FIG. 3.

The details of the circuit breaker driver 800 are shown on FIG. 8. The circuit breaker contacts 815 are normally in the closed position. This is not a normal inline circuit breaker where a high current through the circuit breaker contacts trips the circuit breaker. The circuit breaker contacts are manually closed with a toggle switch and sufficient current through a coil 816 trips the contacts 815 open. This coil 816 is insulated from the circuit breaker contacts. Transistor switch 814 is used to power relay coil 816. Normally transistor 814 is in the off state with the transistor base at near ground potential. When transistor 814 is turned on, the coil 816 is across 18 volts to produce sufficient current through the coil to open the circuit breaker contacts 815. Diode 817 is across coil 816 to short out a reverse inductive kick across the coil.

One of the attributes of driver 800 is that smoke and combustible gas detectors can be connected so that if smoke or combustible gas is detected in the vicinity of the heating appliances, fans and furnaces are disabled. This provides an open flue which aids in the venting of the smoke or combustible gas. The opening of circuit breaker contacts 815 removes power from the flue damper 129 which is spring driven to move it to the fully open position. A gas leak could occur if for some reason the pilot light were extinguished and the gas valve failed to automatically close. The smoke and combustible gas detectors must have an output (such as an alarm driver) which goes high when the danger from smoke or combustible gas is sensed. These outputs are connected into the circuit breaker driver 800 via lines 809 and 810. If either of these lines goes high, either transistor 804 or 805 is turned on and the input to invertor 806 is pulled low. This produces a high output on invertor 806 which goes to the upper input of OR gate 807 to drive its output high. As a consequence of the high on the output of invertor 806, transistor 814 is turned on and the circuit breaker coil 816 is activated to open circuit breaker contacts 815. This removes all power from controller 125 and the alarm 306 sounds. When the smoke or combustible gas problem is eliminated, circuit breaker contacts 815 must be manually reset.

The sensor out of limits signal from the information processor 700 is connected into the circuit breaker driver 800 on input 757. Input 757 goes directly to the input of invertor 811 and normally this invertor output is at a high level. This high level output goes to the reset pin (RS) of counter/timer 812. When the reset pin is at high level, the counter is inhibited and all of its outputs are at a low level. Therefore regardless of which delay tap from the counter is connected into one input of OR gate 807 on path 818, the output of gate 807 will be low unless the smoke or combustible gas detector inputs 809 or 810 are high. Therefore transistor 814 is normally turned off and circuit breaker 815 remains closed.

Suppose input 757 goes high due to spillage from one of the appliance draft hoods. The output of invertor 811 then goes low and the inhibit signal on reset pin RS on counter 812 is removed so that the counter can start operation. It will count half wave rectified 60Hz pulses obtained from the power line and input into the counter on pin CLK through resistor 819. The different taps on the counter remain low until for a particular digit or tap to contain a one which is a high logic level. The delay taps represent 4.25, 8.5, 17, 34, and 68 seconds. Suppose the connection of path 818 is to pin 1 of the counter, the delay from the time input line 757 goes high is then 17 seconds. Therefore 17 seconds after line 757 goes high as spillage starts, the lower input to OR gate 807 is driven high which drives the output of gate 807 high. This turns on transistor 814 to open circuit breaker contacts 815. If the spillage ceases 10 seconds after it began and line 757 again goes low, the reset pin 11 on counter 812 goes high and the counter is reset. This means the counter is inhibited and the outputs remain at a low logic level. As a result, the circuit breaker 815 contacts are not opened. The purpose of the installer selectable delay feature is to avoid nuisance tripping of the circuit breaker due to momentary spillage from a draft hood due to a heating appliance starting into a cold flue. This spillage will usually last for less than 30 seconds. The circuit breaker is tripped if the spillage continues and begins to present a safety problem. The small amount of momentary spillage will not melt the thermal fuse because it takes some time for the heat to conduct through the fuse holding tape 480 (FIG. 4) and heat the fuse to the melting temperature.

Figure 9:
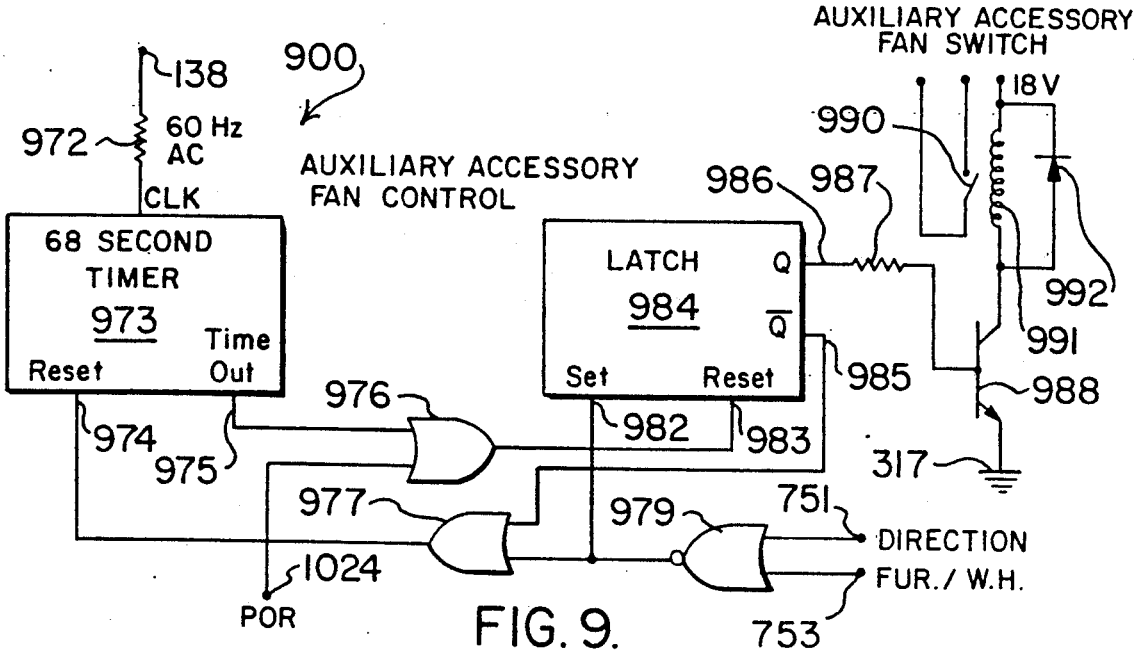
FIG. 9 discloses the circuit details of the fan control circuit 900 of FIG. 3.

FIG. 9 discloses the details of fan control 900. Inputs 751 and 753 are from the information processor 700. Gate 979 is a standard NOR gate which performs an AND function. In other words when the direction line 751 and the furnace/water heater line 753 are both low, the output of gate 979 is high which sets latch 984. This makes output 986 of the latch go high to turn on transistor 988 so that relay coil 991 becomes powered to close contacts 990. Contacts 990 are used, as shown on FIG. 3, to control 120 volts AC which powers the flue fans 121. Therefore when the direction signal 751 goes low, meaning that the damper is being driven open, and line 753 is also low indicating that sensor A is in command status, the flue fans 121 are turned on. The fans are turned off if the latch 984 is reset by output 975 on timer 973 going high. This high logic level is propagated through OR gate 976 to the reset input 983 of latch 984. Timer 973 is a ripple counter whose clock input is a half wave rectified 60Hz signal from the power line. As long as reset input 974 is high, all counter outputs are low and the counter is not counting. As soon as input 974 goes low, the counter 973 starts counting the clock pulses and 68 seconds later its output 975 goes high. However, if the reset line 974 goes high at any time during the 68 seconds, the counter stops counting and output 975 remains low.

When the heating appliance, such as the furnace, in whose draft hood sensor assembly A is mounted and operating, the damper 129 servo direction will oscillate between opening and closing and hence the logic level on line 751 will intermittently go high and low. During normal appliance operation, a direction low signal is expected to be received more frequently than every 68 seconds to reset timer 973 and keep latch 984 in a set state to keep the flue fans running. As soon as the appliance shuts off, there is no more heat input to the flue and the lows on line 751 will be less frequent or will stop because the damper 129 is being closed down. At this point it becomes quite probable that timer 973 will time out to reset latch 984 and turnoff transistor 988 to shut off the fans. When the latch 984 is in a reset state, its output 985 is high to keep timer 973 in a reset state. When power is first applied to controller 125, an initial high pulse is sent over line 1024 (power on reset) through OR gate 976 to reset latch 984 to put the flue fans 121 in an off state.

It is fair question to ask why the fan control 900 is not simplified to turn the fans on with the inverted line 753. This would mean that the fans are on whenever sensor A is in command status. This is fine as long as the heating appliance is operating; but it could remain in command long after the appliance has ceased operating. There is no need to keep the flue fans running in a standby status. On the other hand, with the use of the 68 second timer and under infrequent special circumstances, the flue fans 121 could run somewhat intermittently. This does not turn into an operational problem since the fans are simply used to remove additional heat from the flue for higher efficiency.

Figure 10:
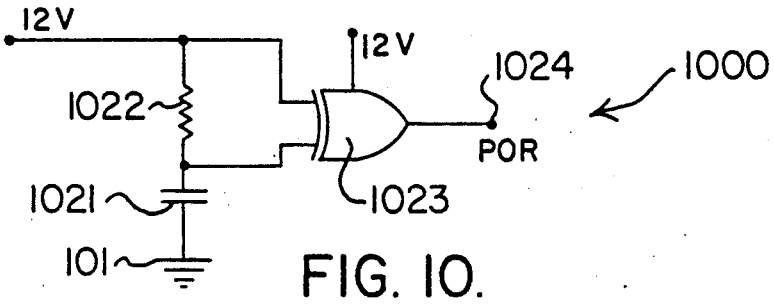
FIG. 10 discloses the details of the power on reset circuit 1000 of FIG. 3.

The purpose of the power on reset circuit 1000 of FIG. 10 is to produce a high logic level momentary pulse on path 1024 when the power supply 12 volts first comes up. This initial pulse is used to set latches and stepper motor driver logic in the correct state at power turn on. In FIG. 10, with capacitor 1021 discharged, as soon as the 12 volt power supply comes up, one input to the exclusive OR gate 1023 is logic high which makes output 1024 go high. Meanwhile capacitor 1021 is charging up through resistor 1022. As soon as the junction between resistor 1022 and capacitor 1021 reaches a high logic level, the lower input of exclusive OR gate goes high and its output 1024 goes low. Therefore, exclusive OR gate output 1024 produces an initial pulse whose width is a fraction of a millisecond as determined by the time constant of resistor 1022 and capacitor 1021.

Figure 11:
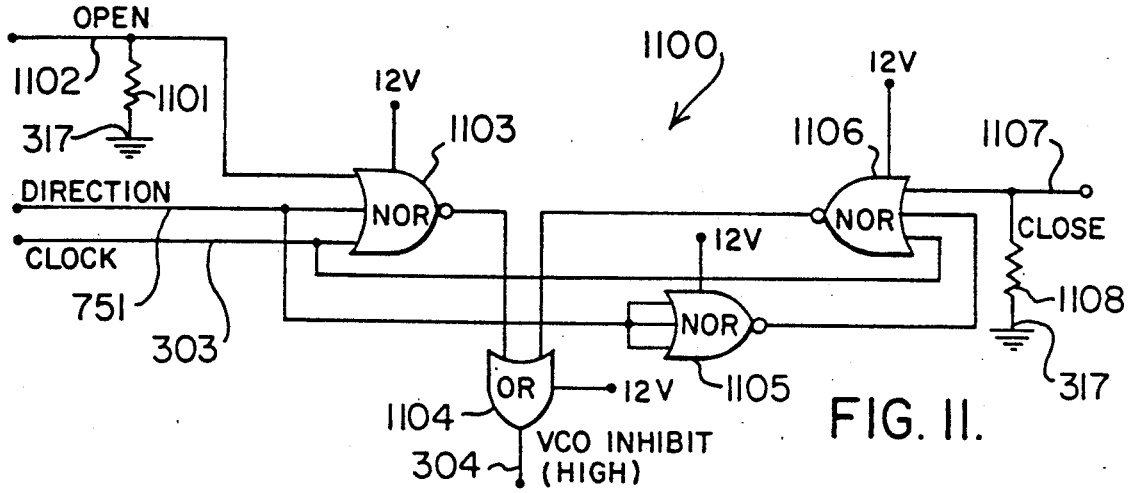
FIG. 11 discloses the circuit details of the limit circuitry 1100 of FIG. 3.

The purpose of limits circuit 1100 shown in detail on FIG. 11 is to stop the damper motor in the fully closed or fully open position yet allow the motor to reverse drive the damper when the direction reverses. On the damper there is a switch which is opened when the damper is in the fully closed position and this produces a low logic level on line 1107. Another switch is opened when the damper goes to the fully open position. This produces a low logic level on line 1102. The switches are normally closed except for the two mentioned extreme positions. To shut off the damper motor, line 304 which is attached to an inhibit pin on the VCO 300 needs to be driven high. Normally this inhibit pin on the VCO is kept at ground potential to permit it to oscillate entirely dependent on the voltage level input on line 741.

Triple input NOR gates 1103 and 1106 perform AND functions so that a gate high output is only obtained if all three inputs are low. Suppose the damper motor 302 is driving damper 129 open and hence the direction signal 751 is a low logic level, the clock oscillates between a high and low level, and line 1102 is a high level until the damper is fully open and then it becomes a low level. Because of the line 1102 high level, the output of gate 1103 will remain low until the line 1102 goes low and the clock signal from VCO 300 goes low. At that instant, the output of gate 1103 goes high and this high is propagated through OR gate 1104 to output 304 and the motor 302 is stopped in the fully open position. During the entire opening sequence, line 1107 remained high and therefore the output of gate 1106 remained low and kept the output of gate 1104 low. From the fully open position where line 304 is high and the motor 302 is stopped, suppose the direction reversed and line 751 goes to a high logic level. At this point the output of gate 1103 goes low. Line 304 also goes low. This allows the VCO 300 to begin oscillating depending on the size of the voltage on line 741 and the motor 302 is driven toward the closed position. As the damper 129 is driven shut, line 1107 remains high and the direction input to gate 1106 is low because the high level direction line 751 goes through an invertor gate 1105 and clock line 303 oscillates between a low and high level. As the damper is driven shut, the output of gate 1106 remains low and consequently the output of gate 1104 is also low. VCO 300 is uninhibited and oscillates at the rate determined by the voltage on line 741. The moment the damper arrives at the fully closed position and when the clock signal 303 goes to the low level, the output of gate 1106 goes high. This high level is propagated through OR gate 1104 to produce a high level on output line 304. In the fully closed position, VCO 300 is inhibited and the motor 302 is stopped in this position. Suppose a heating appliance starts up and direction is reversed, a low level on line 751 drives the damper 129 open. After the invertor gate 1105, the direction signal 751 appears as a high level on the input of gate 1106. Now the output of gate 1106 becomes low and output line 304 also goes low. This makes VCO 300 uninhibited and it will start oscillating at a rate determined by the voltage on line 741 to move the damper blade 129 out of the fully closed position.

The reason for including the clock in the AND function of gates 1103 and 1106 is to inhibit the VCO always at a low output level. If the inhibit signal were to come at a VCO high level, there is the danger that the VCO could produce a narrow pulse which may upset the logic.

| COMPONENTS LIST | |
|---|---|
| Circuit Breaker | Airpax, Cambridge, MD<br>Snapak Series<br>T14-1.100A-06-11L |
| Stepper Motor | Airpax, Cheshire, CT<br>K82402-P2<br>12 volts<br>109 ohms/coil<br>7.5 degrees/step |
| Thermal Fuse | Elmwood Sensors Inc.<br>Pawtucket, RI<br>D085-002<br>Opening temperature 87 deg C. |
| Thermistors | Fenwal Electronics,<br>Milford, MA<br>10,000 ohms @ 25 deg C.<br>197-103LAG-A01<br>5,000 ohms @ 25 deg C.<br>140-502LAG-A01 |
| Voltage Controlled Oscillator (VCO) | CD4046 CMOS phase-locked loop |
| CD4046BC | National Semi Conductor and others<br>Santa Clara, CA |
| CD4070BC | Quad 2-input exclusive-OR gate |
| CD4025C | Triple 3-input NAND gate |
| CD4071BC | Quad 2-input OR buffered B series gate |
| CD4001C | Quad 2-input NOR gate |
| CD4020BC | 14 stage ripple-carry binary counter/divider |
| CD4043BC | TRI-state NOR R/S latches |
| CD4069UBC | Invertor circuits |
| TLC274CN | Quad operational amplifier LinCMOS (Texas Instruments) |

It is to be expressly understood that the claimed invention is not to be limited to the description of the preferred embodiment but encompasses other modifications and alterations within the scope and spirit of the inventive concept.

I claim:

1. In a forced air heating system for a building, a heating appliance comprising a furnace having an exhaust output connected to a venting means for the venting of the exhaust gasses of said furnace, a heat exchanger and a distribution fan in said furnace, a distribution duct system for conveying heat from said furnace to areas within said building served by said duct system, an open air return path exclusive of a dedicated return duct system comprising open areas within said building for returning air from outputs of said distribution duct system back to an input of said fan for the recirculation of said air through said heat exchanger and said distribution duct system, a sensor means for monitoring said venting of said exhaust gasses of said furnace to detect an improper venting of said exhaust gasses when said furnace is operating, and a controller connected to said sensor means for terminating the operation of said furnace in response to said detection of said improper venting by said sensor means.

2. The system of claim 1 in combination with;

a damper in said venting means, means connecting said damper and said controller for controlling the operating position of said damper in response to said monitoring of said venting of said exhaust gasses by said sensor means.

3. The system of claim 2 wherein said means for controlling said damper comprises a stepper motor controlled by an oscillator connected to said controller and wherein said motor is controllably and incrementally moved by said oscillator to open and close said damper.

4. The system of claim 3 wherein said damper comprises means for automatically moving said damper to an open position when the operation of said furnace is terminated.

5. In a forced air heating system for a building, a heating appliance comprising a furnace having an exhaust output connected to a venting means for the venting of the exhaust gasses of said furnace, a heat exchanger and a distribution fan in said furnace, a distribution duct system for conveying heated air from said furnace to areas of said building served by said distribution duct system, an open air return path exclusive of a dedicated return duct system comprising open areas within said building for returning air from outputs of said distribution duct system back to an input of said fan for the recirculation of said air through said heat exchanger and said distribution duct system, a sensor means for monitoring said venting of said exhaust gasses of said furnace to detect an improper venting of said exhaust gasses when said furnace is operating, a controller connected to said sensor means for terminating the operation of said furnace in response to said detection of said improper venting of said exhaust gasses by said sensor means, other fans in said building, means for controllably operating said other fans, and means in said controller for disabling the operation of said other fans in response to said detection of said improper venting of said exhaust gasses by said sensor means.

6. In a forced air heating system for a building,
a heating appliance comprising a furnace having an exhaust output connected to a venting means for the venting of the exhaust gasses of said furnace,
a heat exchanger and a distribution fan in said furnace,
a distribution duct system for conveying heated air from said furnace to areas of said building served by said distribution duct system,
an open air return path exclusive of a dedicated return duct system comprising open areas within said building for returning air from outputs of said distribution duct system back to an input of said fan for the recirculation of said air through said heat exchanger and said distribution duct system,
a first sensor means for monitoring said venting of said exhaust gasses of said furnace to detect an improper venting of said exhaust gasses when said furnace is operating,
a controller connected to said first sensor means for terminating the operation of said furnace in response to said detection of said improper venting by said first sensor means,
a second heating appliance having an exhaust output connected to said venting means for extending exhaust gasses of said second appliance to said venting means,
a second sensor means connected to said controller for monitoring said exhaust gasses supplied by said second appliance to said venting means when said second appliance is operating,
said controller being responsive to a detection of an improper venting of said exhaust gasses of said second appliance by said second sensor means for terminating the operation of said furnace.

7. The system of claim 6 wherein said system further comprises;
fans mounted on said venting means connected to said furnace for dissipating heat from said venting means when said furnace is operating, and
means for controlling the operation of said fans so that said fans operate only when said furnace is operating.

8. The system of claim 1 wherein said sensor means comprises;
a first thermistor mounted inside a draft hood of said furnace for monitoring the temperature inside a relief opening of said draft hood,
a second thermistor mounted exterior to said draft hood for monitoring the temperature of ambient air outside said draft hood,
said thermistors being connected in series across a source of potential from said controller,
means connecting the midpoint of said series connected thermistors to said controller,
the potential of said midpoint representing the temperature differential of said thermistors and the adequacy of said venting of exhaust gasses and
said controller being effective to monitor the potential of said midpoint to determine the adequacy of said venting.

9. The system of claim 8 wherein said sensor means further comprises;
a thermal fuse positioned in said flue adjacent said first thermistor,
said fuse being effective to melt when the temperature inside said draft hood exceeds a predetermined temperature,
means connecting said fuse to said controller,
said controller being responsive to an open circuit created upon the melting of said fuse for terminating the operation of said furnace independent of the signals applied to said controller by said thermistors.

10. The system of claim 6 in combination with;
other fans in said building,
means for controllably operating said other fans,
means for connecting said other fans to said controller,
said controller being operable for disabling the operation of said other fans in response to said detection of an improper venting of said exhaust gasses by either of said sensor means.

11. The system of claim 1 wherein said system further comprises;
detectors for detecting the presence of dangerous gasses within said building, and
means including said controller for terminating the operation of said system upon said detection of said dangerous gasses.

12. In a forced air heating system for a building,
a plurality of heating appliances comprising at least one furnace,
a draft hood on each appliance,
means connecting an output of each hood to a single flue common to all of said hoods for extending exhaust gasses from said appliances to said flue,
a heat exchanger and a distribution fan in said furnace,
a distribution duct system for conveying heat from said furnace to areas of said building served by said duct system,
an open air return path exclusive of a dedicated return duct system comprising open areas of said building for returning air from outputs of said distribution duct system back to an input of said fan for recirculation through said heat exchanger and said distribution duct system,
a sensor means in each of said draft hoods for detecting an inadequate flue draft when the appliance associated with said each hood is operating, and
a controller connected to said sensor means for terminating the operation of all of said appliances in response to said detection of an inadequate flue draft by any one of said sensor means.

13. The system of claim 12 in combination with;
a damper in said flue,
means including said controller for controlling the operating position of said damper in response to the monitoring of said flue draft by said sensor means.

14. The system of claim 13 wherein said means for controlling said damper comprises a stepper motor controlled by an oscillator connected to said controller and wherein said motor is controllably and incrementally moved by said oscillator to open and close said damper.

15. The system of claim 14 wherein said damper comprises means for automatically moving said damper to an open position when the operation of said appliances is terminated.

16. The system of claim 12 in combination with;
other fans in said building,
means for connecting said other fans to said controller,
said controller being operable for disabling the operation of said other fans in response to said detection of said inadequate draft by any one of said sensor means.

17. The system of claim 16 wherein said system further comprises;

flue fans mounted on said flue connected to said furnace for dissipating heat from said flue when said furnace is operating, and means for controlling the operation of said flue fans so that said flue fans operate only when said furnace is operating.

18. The system of claim 12 wherein each of said sensor means comprises;

a first thermistor mounted inside a relief opening of said draft hood associated with said sensor means for monitoring the temperature inside said relief opening, a second thermistor mounted exterior to said draft hood for monitoring the temperature of ambient air, said thermistors being connected in series across a source of potential from said controller, means connecting the midpoint of said thermistors to said controller, the potential of said midpoint representing the temperature differential of said thermistors and the adequacy of said flue draft in the hood associated with said sensor means, said controller being effective to monitor the potential of said midpoint to determine the adequacy of said flue draft in the hood associated with said sensor means.

19. The system of claim 18 wherein each of said sensor means further comprises;

a thermal fuse positioned in said hood adjacent said first thermistor of said sensor means, said fuse being effective to melt when the temperature inside said hood in which said fuse is positioned exceeds a predetermined temperature, means connecting said fuse to said controller, said controller being responsive to an open circuit created upon the melting of said fuse for terminating the operation of said appliance associated with said sensor means independent of the signals applied to said controller by said thermistors of said sensor means.

20. The system of claim 12 wherein said system further comprises;

detectors for detecting the presence of dangerous gasses within said building, and means including said controller for terminating the operation of said appliances upon said detection of said dangerous gasses.

21. The system of claim 12 in combination with an alarm operable in response to the termination of operation of said appliances.

22. In a system having a plurality of heating appliances including at least one furnace, a draft hood on each appliance, means connecting an output of each hood to a single flue common to all of said hoods for extending the exhaust gasses of all of said appliances to said flue, a sensor means in each of said draft hoods for detecting an inadequate flue draft when the appliance associated with each hood is operating, and a controller connected to said sensor means for terminating the operation of said furnace in response to said detection of an inadequate flue draft by any one of said sensor means.

23. The system of claim 22 in combination with;

a damper in said flue, means including said controller for controlling the operating position of said damper in response to the monitoring of said flue draft by said sensor means.

24. The system of claim 23 wherein said means for controlling said damper comprises a stepper motor controlled by an oscillator connected to said controller and wherein said motor is controllably and incrementally moved by said oscillator to open and close said damper.

25. The system of claim 24 wherein said damper comprises means for automatically moving said damper to an open position when the operation of said furnace is terminated.

26. The system of claim 22 in combination with;

other fans in said building, means for connecting said other fans to said controller, said controller being operable for disabling the operation of said other fans in response to said detection of said inadequate draft by any one of said sensor means.

27. The system of claim 22 wherein said system further comprises;

flue fans mounted on said flue connected to said furnace for dissipating heat from said flue when said furnace is operating, and means for controlling the operation of said flue fans so that said flue fans operate only when said furnace is operating.

28. The system of claim 22 wherein each of said sensor means comprises;

a first thermistor mounted inside said hood associated with said sensor means for monitoring the temperature inside said associated hood, a second thermistor mounted exterior to said draft hood for monitoring the temperature of ambient air, said thermistors being connected in series across a source of potential from said controller, means connecting the midpoint of said thermistors to said controller, the potential of said midpoint representing the temperature differential of said thermistors and the adequacy of said flue draft in the hood associated with said sensor means, said controller being effective to monitor the potential of said midpoint to determine the adequacy of said flue draft in the hood associated with said sensor means.

29. The system of claim 28 wherein each of said sensor means further comprises;

a thermal fuse positioned in said hood adjacent said first thermistor of said sensor means, said fuse being effective to melt when the temperature inside said hood in which said fuse is positioned exceeds a predetermined temperature, means connecting said fuse to said controller, said controller being responsive to an open circuit created upon the melting of said fuse for terminating the operation of said appliances independent of the signals applied to said controller by said thermistors of said sensor means.

30. The system of claim 22 wherein said system further comprises;

detectors for detecting the presence of dangerous gasses within said building, and means including said controller for terminating the operation of said system upon said detection of said dangerous gasses by said controller.

31. A method of operating a forced air heating system comprising the steps of:

locating a forced air furnace within the envelope of a building, venting the exhaust gasses of said furnace via a venting means, distributing heated air generated by said furnace through a fan driven supply duct system to locations of said building served by said supply duct system, returning said distributed air to said furnace via open areas within said building and exclusive of a dedicated return duct system for the reheating of said air by said furnace and the redistribution of said air throughout said building via said supply duct system, monitoring the proper venting of said exhaust gasses by said venting means, and terminating the operation of said furnace upon the detection of an improper venting of said exhaust gasses by said venting means.

32. A method of operating a forced air heating system for a building having a heating appliance comprising a furnace having an exhaust output connected to a venting means for venting the exhaust gasses of said furnace, said method comprising the steps of:

conveying heated air from said furnace through a distribution duct system to areas of said building served by said distribution duct system, providing an open air return path exclusive of a dedicated return duct system comprising open areas within said building for returning air from outputs of said distribution duct system back to an input of a distribution fan for recirculation through a heat exchanger of said furnace and said distribution duct system, operating a sensor means for monitoring the exhaust gasses of said furnace to detect an improper venting of exhaust gasses from said furnace to said venting means when said furnace is operating, and operating a controller connected to said sensor means for terminating the operation of said furnace in response to said detection of said improper venting of said exhaust gasses by said sensor means.

33. The method of claim 32 in combination with the additional step of:

operating said controller for controlling the operating position of a damper in said venting means in response to the monitoring of said exhaust gasses by said sensor means.

34. The method of claim 33 wherein said step of controlling said damper position comprises the step of operating a stepper motor controlled by an oscillator connected to said controller to open and close said damper.

35. The method of claim 34 wherein said damper is automatically moved to an open position when the operation of said furnace is terminated.

36. The method of claim 32 in combination with the step of disabling the operation of other fans in said building in response to said detection of an inadequate venting of said exhaust gasses by said sensor means.

37. A method of operating a forced air heating system for a building having a plurality of heating appliances comprising at least one furnace and a draft hood on each appliance, said method comprising the steps of:

connecting an output of each hood to a single flue common to all of said hoods for extending exhaust gasses from said appliances to said flue, conveying heat from said furnace through a distribution duct system to areas of said building served by said duct system, providing an open air return path exclusive of a dedicated return duct system comprising open areas of said building for returning air from outputs of said distribution duct system back to an input of a furnace distribution fan for recirculation through a furnace heat exchanger and said distribution duct system, operating a sensor means in each of said draft hoods for detecting an inadequate flue draft when the appliance associated with said each hood is operating, and operating a controller connected to said sensor means for terminating the operation of said furnace in response to said detection of an inadequate flue draft by any one of said sensor means.

38. The method of claim 37 in combination with the step of operating said controller for controlling the operating position of a damper in said flue in response to the monitoring of said flue draft by said sensor means.

39. The method of claim 38 wherein said damper is controlled by a stepper motor controlled by an oscillator connected to said controller and wherein said motor is controllably and incrementally moved by said oscillator to open and close said damper.

40. The method of claim 39 wherein said damper is automatically moved to an open position when the operation of said furnace is terminated.

41. The method of claim 37 in combination with the step of operating said controller for disabling the operation of other fans in said building in response to said detection of said inadequate draft by any one of said sensor means.

42. The method of claim 37 in combination with the steps of:

operating flue fans mounted on said flue for dissipating heat from said flue when said furnace is operating, and controlling the operation of said flue fans so that said flue fans operate only when said furnace is operating.

43. The system of claim 37 in combination with the step of operating detectors for detecting the presence of dangerous gasses within said building, and terminating the operation of said system upon said detection of said dangerous gasses.

44. The system of claim 37 in combination with the step of operating an alarm in response to the termination of operation of said system.

45. A method of operating a system having a plurality of heating appliances including at least one furnace and a draft hood on each appliance, said method comprising the steps of:

connecting an output of a hood on each appliance to a single flue common to all of said hoods for extending the exhaust gasses of all of said appliances to said flue, operating a sensor means in each of said draft hoods for detecting an inadequate flue draft when the appliance associated with each hood is operating, and operating a controller connected to said sensor means for terminating the operation of said furnace in response to said detection of an inadequate flue draft by any one of said sensor means.

46. The method of claim 45 in combination with the step of operating said controller for controlling the operating position of a damper on said flue in response to the monitoring of said flue draft by said sensor means.

47. The method of claim 45 in combination with the step of:

connecting other fans in said building to said controller, and operating said controller for disabling the operation of said other fans in response to said detection of said inadequate draft by any one of said sensor means.

48. The method of claim 45 in combination with the steps of:

mounting flue fans on said flue for dissipating heat from said flue when said furnace is operating, and controlling the operation of said flue fans so that said flue fans operate only when said furnace is operating.

49. A method of operating a forced air heating system comprising the steps of:

locating a forced air furnace within the envelope of a building, venting exhaust gasses of said furnace via a draft flue extending to the outside of said building;

distributing heated air generated by said furnace through a fan driven supply duct system to locations within said building served by said supply duct system, returning said distributed air to said furnace via open areas within said building exclusive of a dedicated return duct system for the reheating of said air by said furnace and the redistribution of said air throughout said building via said supply duct system, monitoring the draft in said flue, and terminating the operation of said furnace upon the detection of an inadequate flue draft.

50. In a heating system for a building having a plurality of fuel combustion appliances including at least one furnace, venting means for receiving the exhaust gasses of said appliances, a plurality of sensor means each of which is unique to and associated with a different one of said appliances for detecting an improper passage of said exhaust gasses to said venting means from the appliance associated with each of said sensor means when said associated appliance is operating, and a controller connected to said sensor means for inhibiting the operation of said furnace in response to detection by any one of said sensor means of an improper passage of exhaust gasses when the appliance associated with said any one sensor means is operating.

51. The system of claim 50 in combination with;

a fan in said building not associated with said appliances, means for controllably operating said fan, means for connecting said fan to said controller, said controller being operable for disabling the operation of said fan in response to said detection of said inadequate passage of exhaust gasses by any one of said sensor means.

52. A method of operating a system comprising a fuel combustion appliance, said method comprising the steps of:

locating a fuel consuming appliance within the envelope of a building, operating a sensor means for monitoring the proper venting of the exhaust gasses of said appliance by a venting means, operating a fan not associated with said appliance in said building, and terminating the operation of said fan upon the detection by said sensor means of an improper venting of said exhaust gasses.

53. In an air conditioning system for a building, a fuel combustion appliance in said building having an exhaust output connected to a venting means for the venting of the exhaust gasses of said appliance, an air conditioner having a heat exchanger and a distribution fan, a distribution duct system for conveying conditioned air from said heat exchanger to areas within said building served by said duct system, an open air return path exclusive of a dedicated return duct system comprising open areas within said building for returning air from outputs of said distribution duct system back to an input of said fan for the recirculation of said air through said heat exchanger and said distribution duct system, a sensor means for monitoring said venting of said exhaust gasses of said appliance to detect an improper venting of said exhaust gasses when said appliance is operating, and a controller connected to said sensor means for terminating the operation of said air conditioner including said fan in response to said detection by said sensor means of said improper venting.

* * * * *